US007568276B2

(12) United States Patent
Yang et al.

(10) Patent No.: US 7,568,276 B2
(45) Date of Patent: Aug. 4, 2009

(54) APPARATUS FOR PRODUCING AN INDUCTOR

(76) Inventors: Shitong Yang, No. 43, Hejing South Road, Dongsha, Fangcun, Guangzhou, Guangdong (CN) 510385; Jianxiong Lin, No. 43, Hejing South Road, Dongsha, Fangcun, Guangzhou, Guangdong (CN) 510385; Yanliang Li, No. 43, Hejing South Road, Dongsha, Fangcun, Guangzhou, Guangdong (CN) 510385; Wei Liu, No. 43, Hejing South Road, Dongsha, Fangcun, Guangzhou, Guangdong (CN) 510385

( * ) Notice: Subject to any disclaimer, the term of this patent is extended or adjusted under 35 U.S.C. 154(b) by 20 days.

(21) Appl. No.: 10/565,092

(22) PCT Filed: Jul. 15, 2004

(86) PCT No.: PCT/CN2004/000807

§ 371 (c)(1),
(2), (4) Date: Apr. 5, 2007

(87) PCT Pub. No.: WO2005/008697

PCT Pub. Date: Jan. 27, 2005

(65) Prior Publication Data

US 2007/0271771 A1 Nov. 29, 2007

(30) Foreign Application Priority Data

Jul. 18, 2003 (CN) ..... 03 1 39856

(51) Int. Cl.
*H01F 7/06* (2006.01)

(52) U.S. Cl. ..... 29/602.1; 29/605; 29/606; 29/732; 29/742; 29/760; 359/368

(58) Field of Classification Search ..... 29/602.1, 29/605, 749, 755, 760, 742; 359/368; 219/110, 219/56.21, 56.22, 91.21; 250/201.3, 234; 242/365.3

See application file for complete search history.

(56) References Cited

U.S. PATENT DOCUMENTS

| | | | | |
|---|---|---|---|---|
| 4,483,490 | A * | 11/1984 | Engmann et al. | 242/476.1 |
| 4,743,331 | A * | 5/1988 | Nuttall et al. | 156/358 |
| 5,396,696 | A * | 3/1995 | Kurogi et al. | 29/564.6 |
| 5,450,233 | A * | 9/1995 | Yamamoto et al. | 359/368 |
| 6,133,561 | A * | 10/2000 | Toshimitsu et al. | 250/201.3 |
| 6,737,603 | B2 * | 5/2004 | Yang | 219/110 |

FOREIGN PATENT DOCUMENTS

JP 2001-095201 * 6/2001

* cited by examiner

*Primary Examiner*—David P Bryant
*Assistant Examiner*—Tai Nguyen

(57) ABSTRACT

An apparatus for producing an electronic inductor includes a coil winder, a locator of inductor, and a spot electric welder. The coil winder includes a brushless DC motor, a single chip for controlling the DC brushless motor and a digital display screen. Locator of inductor is connected to a rotational axis of the DC motor of the coil winder via a connecting pole. Because the apparatus has multi-function, it can accomplish winding the coil, locating, removing the painting, welding and testing the electrical characteristic at the same time and much of the manual operation is replaced by the apparatus, not only the productivity is improved greatly, but also the product quality is ensured.

3 Claims, 2 Drawing Sheets

APPARATUS FOR PRODUCING AN INDUCTOR

CROSS-REFERENCE TO RELATED APPLICATIONS

This application is a national stage application of International Application No. PCT/CN2004/000807, filed Jul. 15, 2004, which claims priority to Chinese Patent Application No. 03139856.1, filed Jul. 18, 2003, both applications of which are hereby incorporated by reference in their entirety into the present application.

BACKGROUND OF THE INVENTION

1. Field of the Invention

The present invention relates to a special-purpose apparatus for producing an industrial electronic inductor.

2. Description of the Prior Art

Electronic inductor is one of the three most important electronic components. With the rapid development of SMT (surface mounted technology), demand of SMD (surface mounted device) is increased accordingly. In conventional production of electronic inductors, the first procedure is winding certain circles of enamelled wire with predetermined specification around a magnet core in manual or mechanical manner. The second procedure is removing insulative painting at two ends of a leading-out wire of the enamelled wire in mechanical method or chemical method. The third procedure is fixing the magnet core with winded enamelled wire on a ship-shaped magnet core base with two pads and leads. The fourth procedure is positioning two ends of the leading-out wire of the enamelled wire. The fifth procedure is welding the leading-out wires defined at two ends of the enamelled wire onto said two pads of the ship-shaped base, respectively. The sixth procedure is mounting the welded electronic inductor in a jig for testing the electrical characteristic. Because the inductor is so small, and the diameter of used enamelled wire is only 0.03 mm to 0.05 mm, and also because such above mentioned working procedures must be followed to make an inductor, it is easy to imagine how tedious and complex manual operating such a thin enamelled wire with diameter of 0.03 mm to 0.05 mm with the naked eye is.

SUMMARY

Accordingly, an object of the embodiment is to provide an improved apparatus for producing electronic inductor. The apparatus can accomplish winding the coil, locating, removing the painting, welding and testing the electrical characteristic at the same time, therefore improving the productivity and welding quality.

In an embodiment of the invention, the apparatus for producing an electronic inductor comprises a coil winder, a locator of inductor, and a spot electric welder. The locator of inductor is located under a welding head of the spot electric welder and a jig of the welding head. The locator of inductor connects with a brushless DC motor via a connecting pole, and the brushless DC motor connects with a single chip and a digital display screen.

The coil winder has the function of setting, controlling and displaying all variable parameters desired in producing the inductor, such as circles and diameter of the winded enamelled wire, presetting and controlling of forward or backward rotation circuit, starting, braking, segment, zero trimming of circles, segment regression, rollfront segment, rollback segment, slow starting, crash stopping, and output statistics.

The locator of the inductor has a pole-shaped figure, and a recess is defined at a middle of an upper surface thereof. A "7" shaped block is defined beside the recess for clasping a ship-shaped base of the inductor in said recess, and the "7" shaped block is fixed onto main body of the locator via a cotter pin and a spring. The locator of inductor defines a port in a lower end thereof for being mounted at axis of the brushless DC motor directly. The recess can be made, according to the variable specifications of the ship-shaped base, not only to mount and dismount the ship-shaped base conveniently, but also to fix and position the ship-shaped base. When the lower end of the "7" shaped block is pressed down, the end of the "7" shaped block that is near the recess opens a opening, and the ship-shaped base can be mounted in or dismounted from the recess. When the lower end of the "7" shaped block is released, the spring will close the opening, and the ship-shaped base is clasped tightly. The "7" shaped block is hided in a slot that is in communication with the recess at normal times, and it is flushed with the upper surface.

In manufacturing of the locator of inductor, the locator is separated into two insulated parts by two corresponding ends of the leading-out wire of the inductor. The locator of inductor can also be made of insulative material, or an insulative material is placed at bottom of the recess, therefore two leads of the soldered inductor connect only with the soldered enamelled wire and insulate from other parts. Therefore, it is not necessary to dismount the welded inductor for testing electrical characteristic thereof, and the testing can be accomplished in the locator directly.

The used spot electrical welder is a welder that is adapt to weld enamelled wires directly (The Chinese patent number is 01117808.X ). The spot electric welder has the function of directly welding enamelled wires by one side without stripping the insulative painting beforehand, and the solder joint is firm and thin. A weld head is defined above the locator of the inductor, and the weld head is aligned accurately with a pad that is placed on a workpiece base of the locator for conducting welding conveniently.

For enlarged displaying all the production processes of winding and welding of the electrical inductor, a single microscope, a camera (CCD) and a monitor can be added to the apparatus. The single microscope connects with the camera directly, and as long as the single microscope is aligned with and focuses on the workpiece, said processes can be enlarged displayed clearly. Because the locator and the weld head can be positioned accurately, if it is not necessary to enlarged display the processes, said components can also be omitted.

Before using the apparatus of the embodiment, the magnet core is fixed on the ship-shaped base tightly and therefore forming a sketch workpiece of the inductor. In use, when the workpiece is disposed in the recess of the locator, the first weld point of the leading-out wire of the enamelled wire can be welded at the pad of the ship-shaped base. Then the coil winder is startup, and predetermined circles of enamelled wires are winded around the magnet core. Another non-welded pad is now positioned under the weld head, and the pad is welded with the leading-out wire of another end of the enamelled wire, therefore the production of the inductor is accomplished. At this time, electrical testing for the just manufactured inductor can be conducted subsequently, therefore process of remounting jigs for electrical testing is omitted. Because the apparatus has multi-function, it can accomplish winding the coil, localizing, removing the painting, welding and testing the electrical characteristic at the same time and much of the hand work is replaced by the apparatus, not only the productivity is improved greatly, but also the product quality is ensured.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe an embodiment of the present invention in detail.

Figure 1:
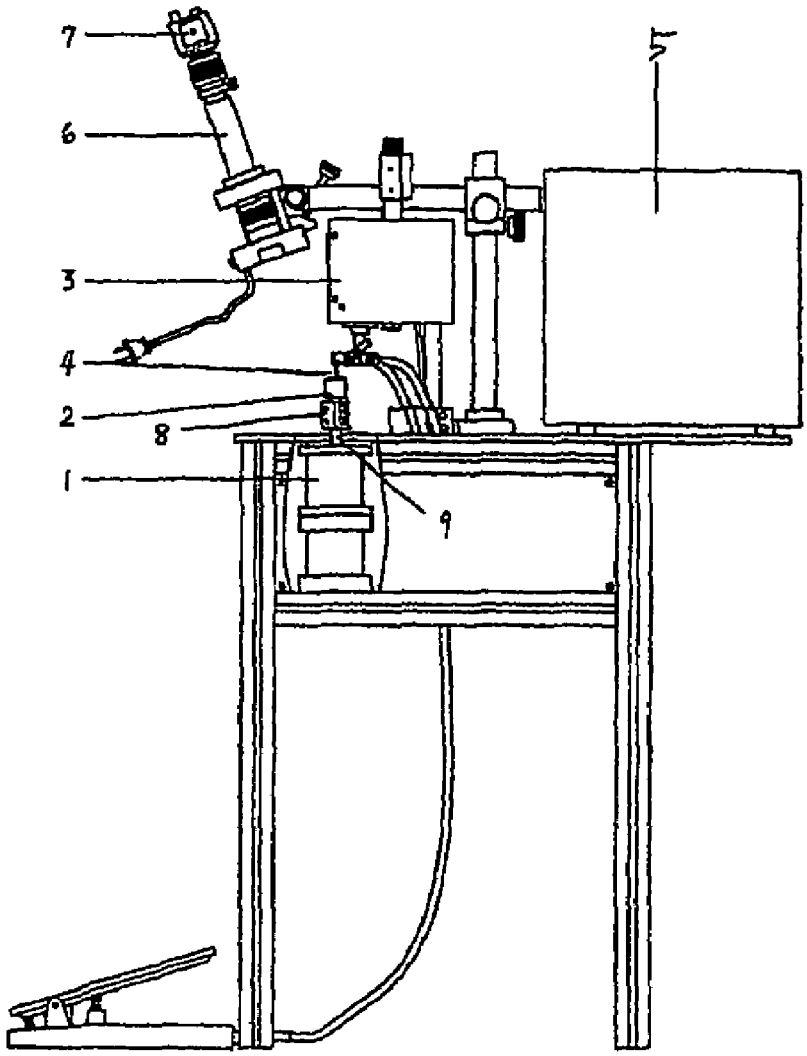
FIG. 1 is a structural drawing of an apparatus for producing inductor in accordance with an embodiment of the present invention.

Referring to FIG. 1, an apparatus for producing an electronic inductor comprises a coil winder, a locator of inductor 2, and a spot electric welder 3. The locator of inductor 2 is located under a welding head 4 of the spot electric welder and a jig of the welding head. The locator of inductor connects with a brushless DC motor 1 via a connecting pole 8, and the brushless DC motor 1 connects with a single chip and a digital display screen.

For enlarged displaying all the production processes of winding and welding of the electrical inductor, a single microscope 6, a camera (CCD) 7 and a monitor 5 can be added to the front of the apparatus.

Figure 2:
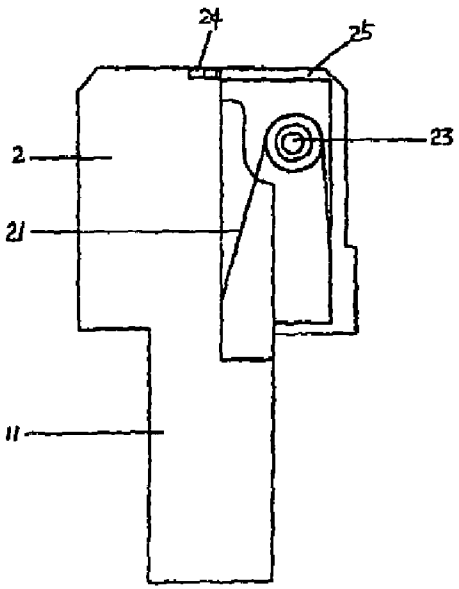
FIG. 2 is a structural drawing of the locator of inductor in accordance with the embodiment of the present invention.

In FIG. 2, the locator of the inductor has a pole-shaped figure, and a recess 24 is defined at a middle of an upper surface thereof for fixing a ship-shaped base of the inductor. A "7" shaped block 25 is defined beside the recess 24 for clasping the ship-shaped base in said recess, and the "7" shaped block is fixed onto main body of the locator via a cotter pin 23 and a spring 21. The locator of inductor defines a port at a lower end 11 thereof for being mounted at axis 9 of the brushless DC motor directly. The locator of inductor can be made of metal material or plastic material, and it can be made to a cylinder shape.

Figure 3:
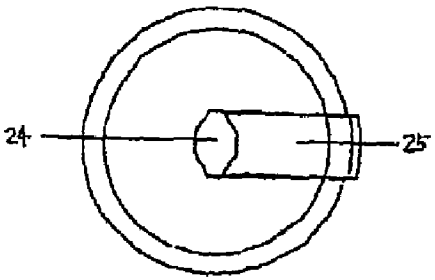
FIG. 3 is a structural drawing of upper surface of the locator of inductor.

In FIG. 3, the recess is designated at 24, and a "7" shaped block 25 is defined beside the recess 24 for clasping the ship-shaped base in said recess.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An apparatus for producing an electronic inductor comprising a coil winder, a locator of inductor, and a spot electric welder, the locator of inductor being located under a welding head of the spot electric weld and a jig of the welding head, the locator of inductor connecting with a brushless DC motor via a connecting pole, the brushless DC motor connecting with a single chip and a digital display screen, the locator of the inductor has a pole-shaped figure, and a recess is defined at a middle of an upper surface thereof for fixing a base of the inductor, and the locator of inductor defines a port at a lower end thereof for being mounted at axis of the brushless DC motor directly.

2. The apparatus for producing an electronic inductor as claimed in claim 1, wherein the spot electric welder is a welder that can weld enameled wires directly.

3. The apparatus for producing an electronic inductor as claimed in claim 1, wherein a camera CCD is added to the front of the apparatus.

* * * * *